US008181304B1

(12) United States Patent
Kamath

(10) Patent No.: US 8,181,304 B1
(45) Date of Patent: May 22, 2012

(54) IMPLEMENT FOR BRUSHING HAIR HAVING A TANGLE REDUCING PRONG CONFIGURATION

(76) Inventor: Yashavanth K. Kamath, Monmouth Junction, NJ (US)

( * ) Notice: Subject to any disclaimer, the term of this patent is extended or adjusted under 35 U.S.C. 154(b) by 466 days.

(21) Appl. No.: 12/415,165

(22) Filed: Mar. 31, 2009

(51) Int. Cl.
*A46B 9/02* (2006.01)

(52) U.S. Cl. ..... 15/160; 15/186; 15/DIG. 5; 132/120; 132/161; D4/133; D4/134; D4/136

(58) Field of Classification Search ..... 15/159.1, 15/160, 186, 187, DIG. 5; 132/120, 161; D4/130, 132–134, 136
See application file for complete search history.

(56) References Cited

U.S. PATENT DOCUMENTS

| | | | | | |
|---|---|---|---|---|---|
| 1,518,480 | A | * | 12/1924 | Buchanan | 15/186 |
| D121,092 | S | * | 6/1940 | Gustafson | D4/133 |
| 2,610,637 | A | * | 9/1952 | Fuentes | 132/120 |
| 2,633,591 | A | * | 4/1953 | Servilla | 15/160 |
| 2,651,810 | A | * | 9/1953 | Snyder | 264/519 |
| D260,949 | S | | 9/1981 | Megna | |
| 4,730,361 | A | * | 3/1988 | Koffler | 15/160 |
| 5,704,376 | A | | 1/1998 | Ogunro | |
| 2005/0015909 | A1 | * | 1/2005 | Spitale et al. | 15/191.1 |
| 2005/0081875 | A1 | | 4/2005 | Wang | |

FOREIGN PATENT DOCUMENTS

| | | | |
|---|---|---|---|
| JP | 10-179257 | * | 7/1998 |
| JP | 2001-137045 | * | 5/2001 |
| JP | 2006-345894 | * | 12/2006 |

* cited by examiner

*Primary Examiner* — Mark Spisich
(74) *Attorney, Agent, or Firm* — LaMorte & Associates, P.C.

(57) ABSTRACT

A system and method of configuring the prongs on a hairbrush. A brush head is provided having a face surface and a plurality of prongs. The prongs are arranged in parallel rows that include at least a first row, a second row, and a third row. The prongs are positioned in the first row of prongs so that the first row of prongs engages a first volume of hair from a lock of hair being brushed. The prongs are positioned in the second row of prongs so that the second row of prongs engages a second volume of hair that is greater than the first volume of hair. Likewise, the prongs in the third row of prongs are positioned so that the third row of prongs engages a third volume of hair that is greater than the second volume of hair.

11 Claims, 8 Drawing Sheets

IMPLEMENT FOR BRUSHING HAIR HAVING A TANGLE REDUCING PRONG CONFIGURATION

BACKGROUND OF THE INVENTION

1. Field of the Invention

In general, the present invention relates to the structure of combs, brushes and other such implements that are used to control a person's hair. More particularly, the present invention relates to the configuration and orientation of prongs that extend from combs and brushes.

2. Prior Art Description

Combs and brushes predate recorded history. In this vast period of time, combs and brushes have been created in countless designs using a wide range of materials. Combs are generally rigid structures having a multitude of extending prongs that protrude from a common base in a single linear line. Brushes have bristles or prongs that extend from a common base along multiple parallel lines. As such, combs tend to be thin while brushes tend to be thick.

In both combs and brushes, the spacing between the various prongs tends to be uniform. The prongs of the brush or comb are advanced into a person's hair. The brush or comb is then moved laterally across the hair. This causes the hair to move through the space between the prongs, thus causing the hair to straighten into a uniform direction.

As will be understood, not all people have the same type of hair. Some people have straight hair, other people have wavy or curly hair. Likewise, some people have fine hair while others have coarse hair. Different hair reacts to brushing and combing in different ways. Most people are capable of pulling a comb or brush through their hair. Typically, the prongs of a comb or brush will pass through the hair with only minor resistance. However, the resistance generally increases as the prongs of the comb or brush approach the free ends of the hair. A strand of hair tends to become more wavy as it approaches its free end. Likewise, hair is more likely to bend and twist as it approaches its free end. Furthermore, the free end of a strand of hair may split or fray. Accordingly, when groups of hairs are taken together, the volume occupied by the hair generally increases toward the free ends of the hairs.

As mentioned, when a comb or brush is pulled through a person's hair, the hair moves through the spaces between the prongs of the comb or brush. The space between the prongs does not change. However, due to many factors the volume of the hair increases as the prongs approach the free ends of the hair. Often this causes the hair to bind, wherein the hair cannot fit through the space available between the prongs. This causes the comb or brush to snag and stop. This phenomenon is commonly referred to as a "tangle".

In order to work past a tangle, a person first removes the comb or brush and then tries again by engaging less hair in the comb or brush. This is typically done by advancing the prongs of the brush or comb only slightly into the hair, thereby penetrating less into the hair. Alternately, a person may increase the pulling force on the comb or brush to force the tangled hair through the prongs. If a person pulls too strongly, hair strands can break. Hair can be pulled from the scalp or otherwise be damaged.

In the prior art, combs and brushes have been designed in an attempt to minimize snags caused by tangles. Typically, the prior art approach has been to create combs and brushes with flexible prongs that can yield to a tangle, or produce combs and brushes with prongs too wide or too shallow to catch a tangle. Combs and brushes with flexible prongs are exemplified by U.S. Pat. No. D 260,949 to Megna, entitled Hair Brush. Combs and brushes with prongs too wide to catch a tangle are exemplified by U.S. Patent Application Publication No. 2005/0081875 to Wang, entitled Brush With Combing Members Having Ribs To Facilitate Combing Of Tangled Hair Strands. Lastly, combs and brushes with prongs too shallow to catch a tangle are exemplified by U.S. Pat. No. 5,704,376 to Ogunro, entitled Strand-Separating Apparatus.

The problem associated with such prior art combs and brushes is that if the prongs are spaced too wide, too shallow, or are too flexible, then the comb or brush becomes ineffective in moving and aligning the hair. This is especially true if a person has a full head of thick hair. Accordingly, such prior art combs and brushes tangle less but take much longer to effectively brush a full head of hair. Also such, such prior art combs and brushes do not serve to effectively separate tangled hair.

A need therefore exists for a comb or brush with a prong design that combs the same amount of hair as a traditional comb or brush, yet effectively prevents tangling in the hair as it passes through the prongs. This need is met by the present invention as described and claimed below.

SUMMARY OF THE INVENTION

The present invention is a system and method of configuring the prongs on a hairbrush to reduce the force needed to advance the hairbrush through a lock of hair. A brush head is provided having a face surface and a plurality of prongs that extend from the face surface. The prongs are arranged in a plurality of parallel rows, wherein the rows include at least a first row of prongs, a second row of prongs and a third row of prongs that pass through the lock of hair as the brush head is pulled along the lock of hair to brush the lock of hair.

The plurality of prongs is positioned in the first row of prongs so that the first row of prongs engages a first volume of hair from a lock of hair being brushed. The plurality of prongs is positioned in the second row of prongs so that the second row of prongs engages a second volume of hair that is greater than the first volume of hair. Likewise, the plurality of prongs in the third row of prongs is positioned so that the third row of prongs engages a third volume of hair that is greater than the second volume of hair.

By positioning the prongs to gradually engage more locks of hair, many problems of tangling can be eliminated without adversely affecting the ability of the brush to style hair.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention hairbrush can be embodied in many ways, the hairbrush is illustrated in four exemplary embodiments. These embodiments are selected in order to set forth the best modes contemplated for the invention. The illustrated embodiments, however, are merely exemplary and should not be considered a limitation when interpreting the scope of the appended claims.

Figure 1:
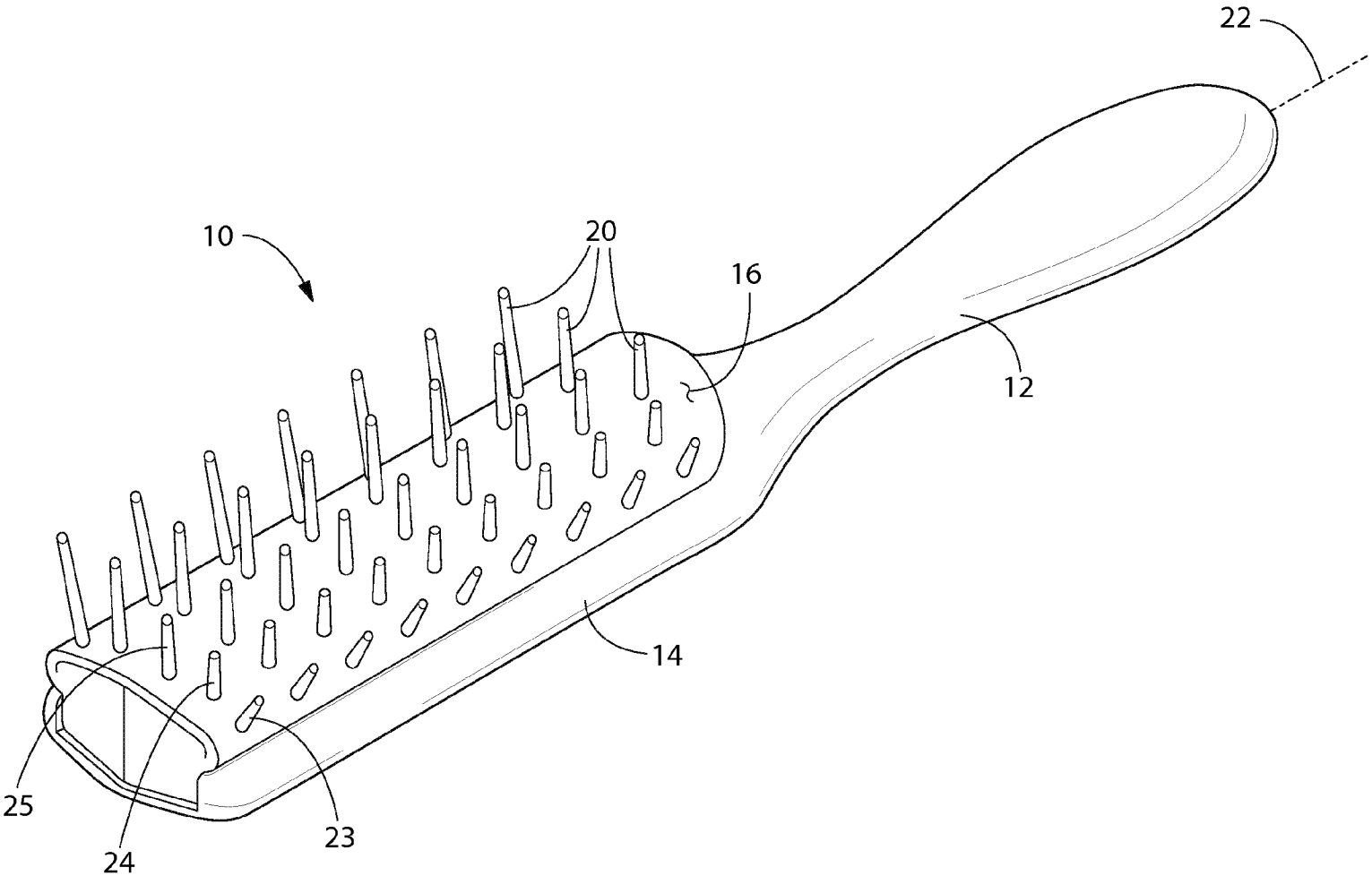
FIG. 1 is a perspective view of a first exemplary embodiment of a hairbrush in accordance with the present invention.
Figure 2:
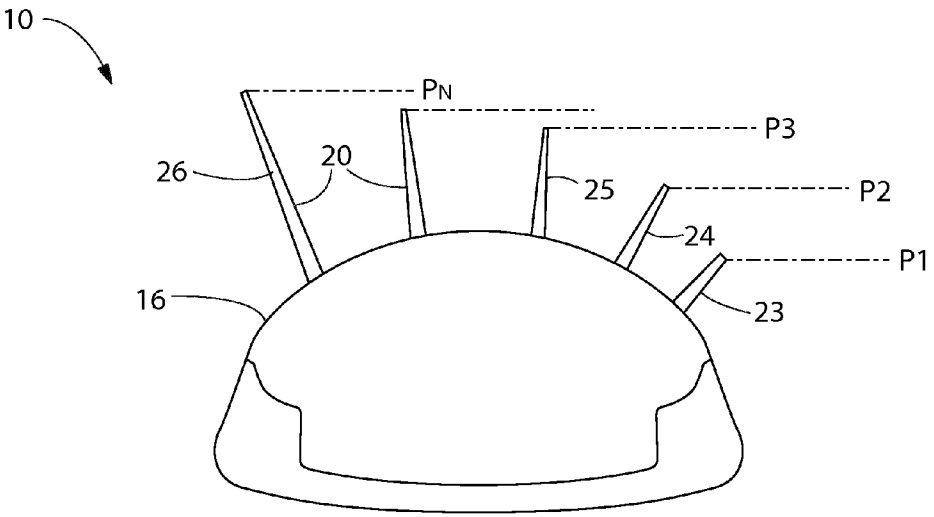
FIG. 2 is a side view of the head of the hairbrush shown in FIG. 1.

Referring to FIG. 1, in conjunction with FIG. 2, a first embodiment of a brush 10 is shown in accordance with the present invention. The brush 10 has a handle 12 and a head 14. The head 14 of the brush 10 has a face surface 16 from which a plurality of prongs 20 extends. The face surface 16 of the head 14 can be flat. However, in the illustrated embodiment, the face surface 16 is curved, having a generally convex shape.

The pluralities of prongs 20 extend from the face surface 16 of the head 14. The prongs 20 are arranged in a series of parallel rows 23, 24, 25 and columns. For the purpose of reference, the rows 23, 24, 25 are considered the lines of prongs 20 parallel to the longitudinal axis 22 of the handle 12. The columns are the lines of prongs 20 perpendicular to the longitudinal axis 22 of the handle 12.

As can be seen, most clearly from FIG. 2, when the brush 10 is laid flat so that the face surface 16 points vertically upward, each of the rows 23, 24, 25 of prongs 20 terminates in a different horizontal plane. The first row 23 of prongs 20 terminates in a first horizontal plane P1. The second row 24 of prongs 20 terminates in a second horizontal plane P2 that is elevated higher than that of the first horizontal plane P1. The third row 25 of prongs 20 terminates in a third horizontal plane P3 that is elevated higher than that of both the first horizontal plane P1 and the second horizontal plane P2. The pattern is repeated for each subsequent row of prongs 20. It will therefore be understood that the last row 26 of prongs 20 terminates in a horizontal plane Pn that is higher than all of the previous rows of prongs 20.

The increase in height for each subsequent row of prongs 20 is not created by the curvature of the face surface 16. Rather, each row of prongs 20 has a height that is greater than the row in front of it and shorter than the row behind. Preferably, the height of the prongs 20 in each row is between 10% and 25% greater than the height of the immediately preceding row. Overall, it is preferred that the height of the prongs 20 in the last row 26 be at least twice as long as the prongs 20 in the first row 23. Accordingly, the prongs 20 in the last row 26 can affect a much greater volume of hair than the prongs 20 in the first row 23.

Although the prongs 20 in each of the rows 23, 24, 25, 26 terminate in different heights, the prongs 20 of the various rows align in straight columns. A gap space exists between the various columns that is generally equal to the space between rows.

When brushing a person's hair, the prongs of a brush are advanced into a lock of hair and then pulled through the hair toward the free ends of the hair. The force needed to pull the brush through the central portions of a lock of hair is called the mid-length force. As the prongs of the brush approach the free ends of the lock of hair, the force needed to advance the brush increases until it reaches a maximum end-peak force. Typically, the end-peak force is greater than the mid-length force.

Figure 3:
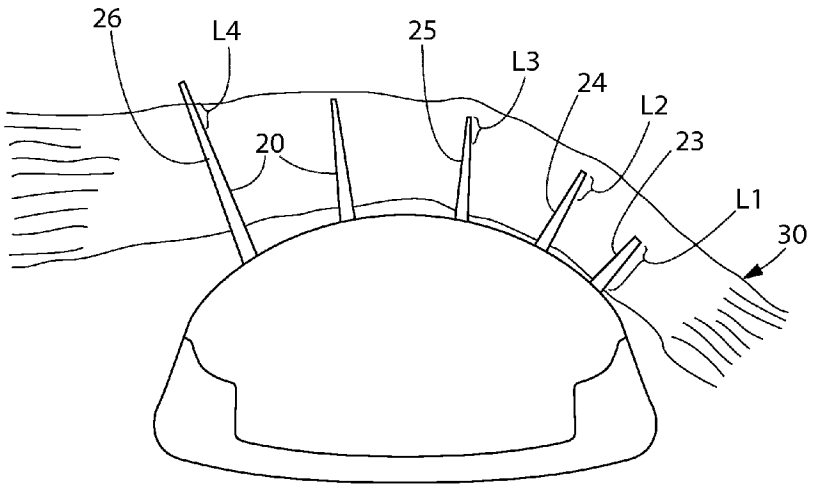
FIG. 3 shows the configuration of FIG. 2 engaged with a lock of hair.

Referring to FIG. 3, it can be seen that when the present invention brush is advanced through a lock of hair 30, each row of prongs 20 initially engages a different layer of hair contained within the lock. The first row 23 of prongs 20 engages a thin first layer L1 of the hair. Prongs 20 in the first row 23 divide the hair within that first layer L1 along paths between the prongs 20. Since the first layer L1 is thin, the amount of hair affected by the first row 23 of prongs 20 is small. As a result, tangling in the hair is kept low as the prongs 20 of the first row 23 approach the free ends of the lock of hair 30.

The second row 24 of prongs 20 engages a thin second layer L2 of the hair, just above the first layer L1. The second row 24 of prongs 20 also engages the first layer L1 of hair. However, the first layer L1 of hair has been preconditioned by the first row 23 of prongs 20 and existing tangles have been removed. Prongs 20 in the second row 24 divide the hair within that second layer L2 along paths between the prongs 20. The hair below the second layer L2 is already divided among the paths. The hair above the second layer L2 is not yet engaged by any prongs 20. Since the second layer L2 is thin, the amount of tangling in the hair is minimal as the prongs 20 of the second row 24 approach the free ends of the lock of hair 30.

The third row 25 of prongs 20 engages a thin third layer L3 of the hair, just above the second layer L2. Prongs 20 in the third row 25 divide the hair within that third layer L3 into paths between the prongs 20. The hair below the third layer L3 is already divided among the paths. The hair above the third layer L3 is not yet engaged by any prongs 20. Since the third layer L3 is thin, the amount of tangling in the hair is minimal as the prongs 20 of the third row 25 approach the free ends of the lock of hair 30.

The above pattern is repeated for all subsequent rows of prongs 20 until the last row 26 of prongs 20. The last row 26 of prongs 20 engages a thin last layer L4 of the hair. Prongs 20 in the last row 26 divide the hair within that last layer L4 along paths between the prongs 20. The hair below the last layer L4 is already divided among the paths. Since the last layer L4 is thin, the amount of tangling in the hair is minimal as the prongs 20 of the last row 26 approach the free ends of the lock of hair.

In the shown embodiment each row has different sized prongs. It will be understood that redundant rows of prongs can be added, wherein a redundant row of prongs is the same size as the preceding row. Accordingly, redundant rows of prongs can be placed between the first, second, third and subsequent rows.

Experimentation was preformed comparing the pull forces of the present invention brush 10 of FIGS. 1-3 with a traditional brush having the same shaped face surface and the same number of prongs, but each of the prongs being the same length. Results show that the present invention has a mid-length pull force through the lock of hair that is 42% lower than that of the prior art brush. Likewise, the end-peak force of the present invention is 64% lower than that of the prior art brush. It will be understood that the mid-length pull force and the end-peak force vary as a function of hair type and brush design. The numbers cited are calculated from real experimental data achieved using a typical brush design and a single hair type.

Altering the height of the prong rows is only one technique that can be used to reduce mid-length pull force and end-peak pull force through a lock of hair. An alternate technique is to alter the number of prongs in each of the rows.

Figure 4:
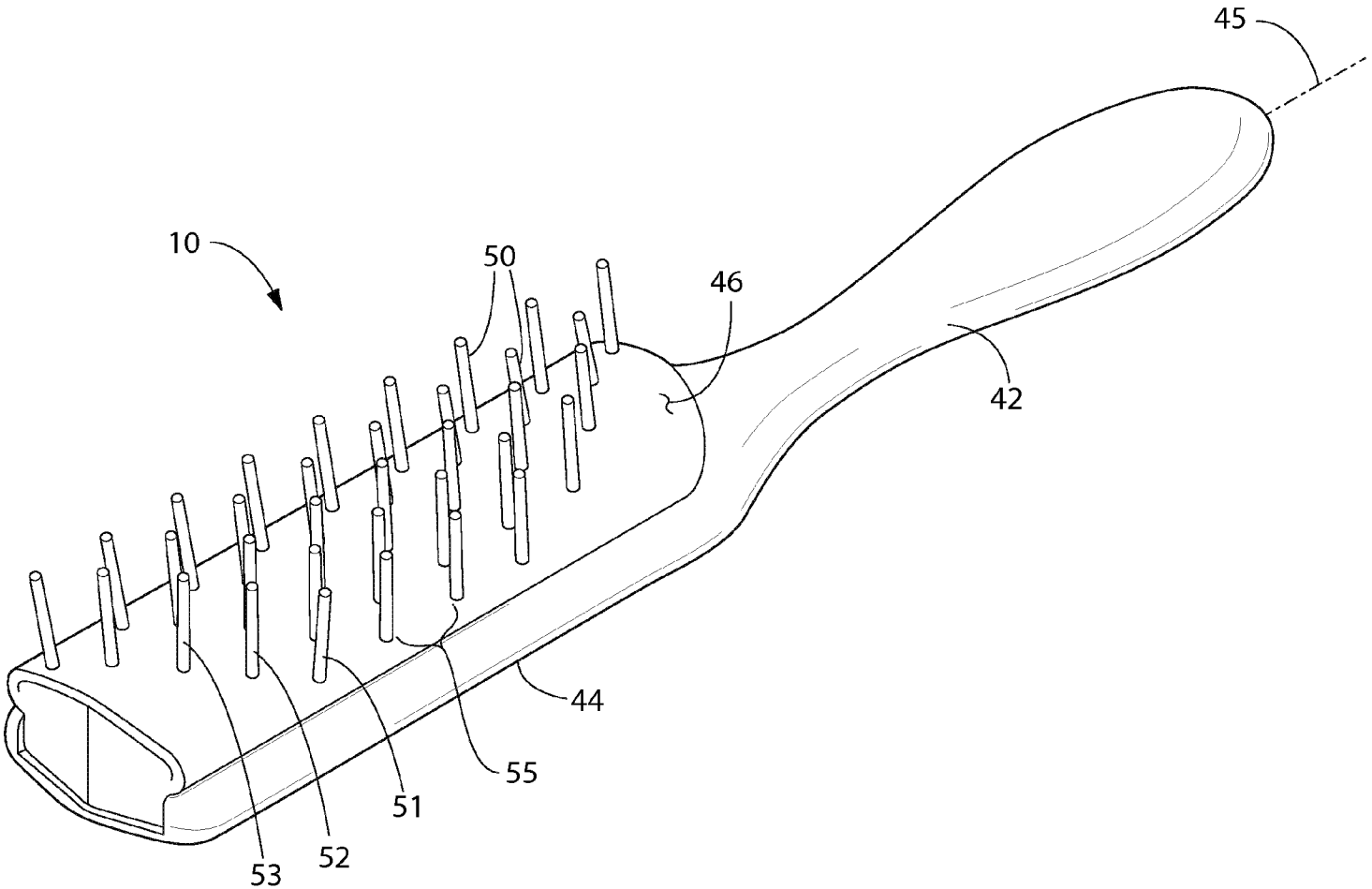
FIG. 4 is a perspective view of a second exemplary embodiment of a hairbrush in accordance with the present invention.

Referring to FIG. 4, a second embodiment of a brush 40 is shown in accordance with the present invention. The brush 40 has a handle 42 and a head 44. The head 44 of the brush 40 has a face surface 46 from which a plurality of prongs 50 extend.

The face surface 46 of the head 44 can be flat. However, in the illustrated embodiment the face surface 46 is curved, having a generally convex shape.

The plurality of prongs 50 extend from the face surface 46 of the head 44. The prongs 50 are arranged in a series of parallel rows and columns. For the purpose of reference, the rows are considered the lines of prongs parallel to the longitudinal axis 45 of the handle 42. The columns are the lines of prongs 50 perpendicular to the longitudinal axis 45 of the handle 42.

As can be seen, when the brush 40 is laid flat, each of the rows 51, 52, 53 of prongs 50 are parallel. However, the number of prongs 50 in each row varies. The first row 51 of prongs 50 has only a few prongs 50. The second row 52 has a number of prongs 50 greater than the first row. The third row 53 has a number of prongs greater than that of the second row 52. The pattern is repeated for each subsequent row of prongs 50. It will therefore be understood that the last row of prongs 54 has the greatest number of prongs.

Although the number of prongs 50 in each row differ, the prongs 50 of the various rows 51, 52, 53, 54 align in straight columns. A gap space 55 exists between the various columns that are generally equal in distance.

Figure 5:
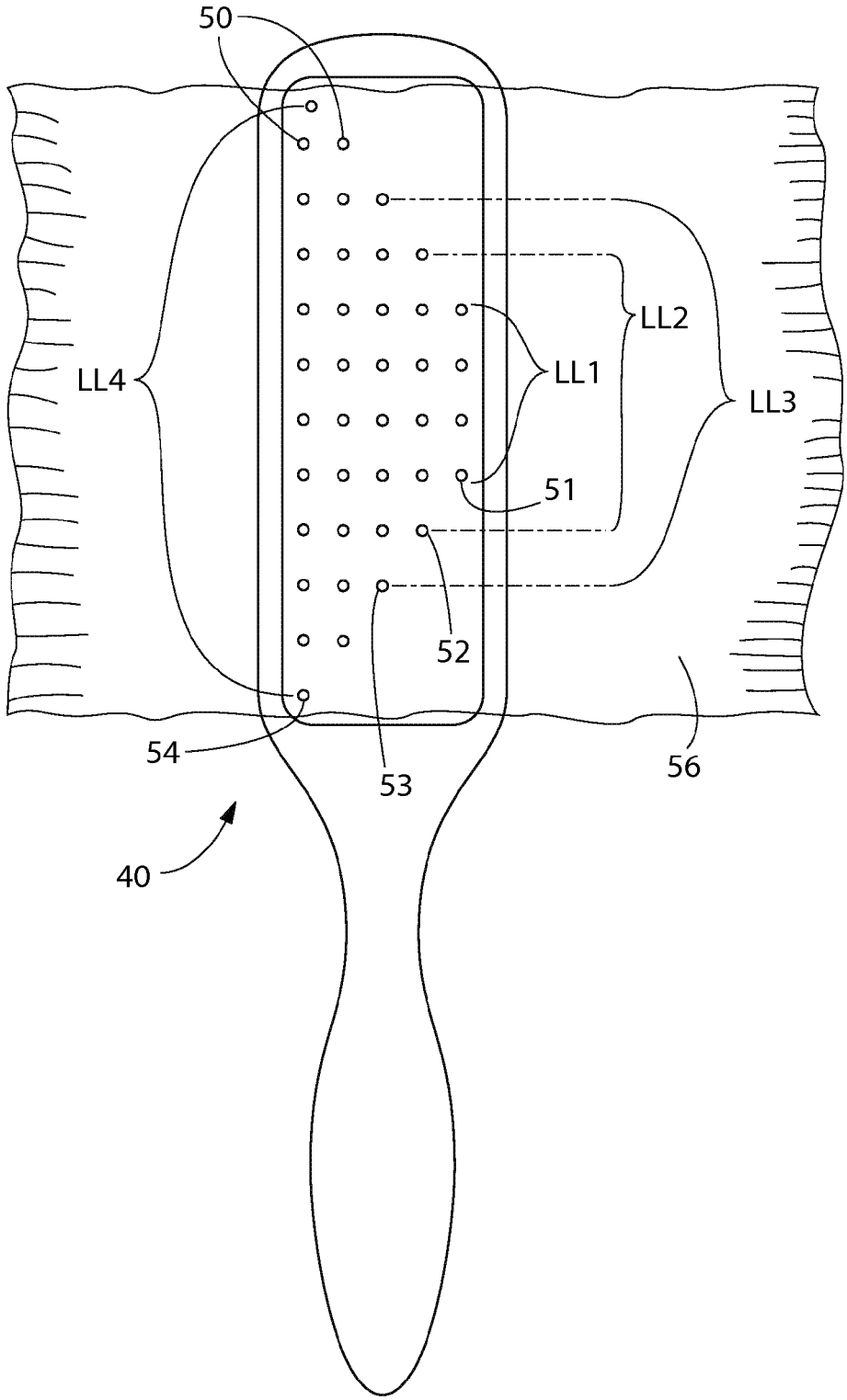
FIG. 5 is a top view of the head of the hairbrush shown in FIG. 4 engaging a lock of hair.

When brushing a person's hair, the prongs 50 of the brush 40 are advanced into a lock of hair and then pulled through the hair toward the free ends of the hair. Referring to FIG. 5, it can be seen that when the present invention brush 40 is advanced through a lock of hair 56, each row of prongs 50 initially engages a different layer of hair contained within the lock. The first row 51 of prongs 50 engages a thin first layer LL1 of the hair. Prongs 50 in the first row 51 divide the hair within that first layer LL1 along paths between the prongs 50. Since the first layer LL1 is thin, the amount of tangling in the hair is minimal as the prongs 50 of the first row 51 approach the free ends of the lock of hair.

The second row 52 of prongs 50 engages two thin second layers LL2 of the hair, just adjacent the first layer LL1. Prongs 50 in the second row 52 divide the hair within those second layers LL2 into paths between the prongs 50. The hair between the second layers LL2 is already divided among the paths by the first row 51 of prongs 50. The hair outside the second layers LL2 is not yet engaged by any prongs 50. Since the second layers LL2 are thin, the amount of tangling in the hair is minimal as the prongs of the second row 52 approach the free ends of the lock of hair.

The third row 53 of prongs 50 engages two thin third layers LL3 of the hair, just outside the second layers LL2. Prongs 50 in the third row 53 divide the hair within those third layers LL3 into paths between the prongs 50. The hair between the third layers LL3 is already divided among the paths. The hair outside the third layers LL3 is not yet engaged by any prongs 50. Since the third layers LL3 are thin, the amount of tangling in the hair is minimal as the prongs 50 of the third row 53 approach the free ends of the lock of hair 56.

The above pattern is repeated for all subsequent rows of prongs 50 until the last row 54 of prongs. The last row 54 of prongs 50 engages two thin last layers LL4 of the hair. Prongs 50 in the last row 54 divide the hair within those last layers LL4 along paths between the prongs 50. The hair inside the last layers LL4 is already divided among the paths. Since the last layers LL4 are thin, the amount of tangling in the hair is minimal as the prongs 50 of the last row 54 approach the free ends of the lock of hair 56.

Experimentation was preformed comparing the pull forces of the present invention brush 40 of FIGS. 4 and 5 with a traditional brush having the same shaped face surface and the same number of prongs 50 in each row. Results show that the present invention has a mid-length pull force through the lock of hair that is 29% lower than that of a prior art brush. Likewise, the end-peak force of the present invention was 30% lower than that of a prior art brush. It will be understood that the mid-length pull force and the end-peak force vary as a function of hair type and brush design. The numbers cited are calculated from real experimental data achieved using a typical brush design and a single hair type.

Figure 6:
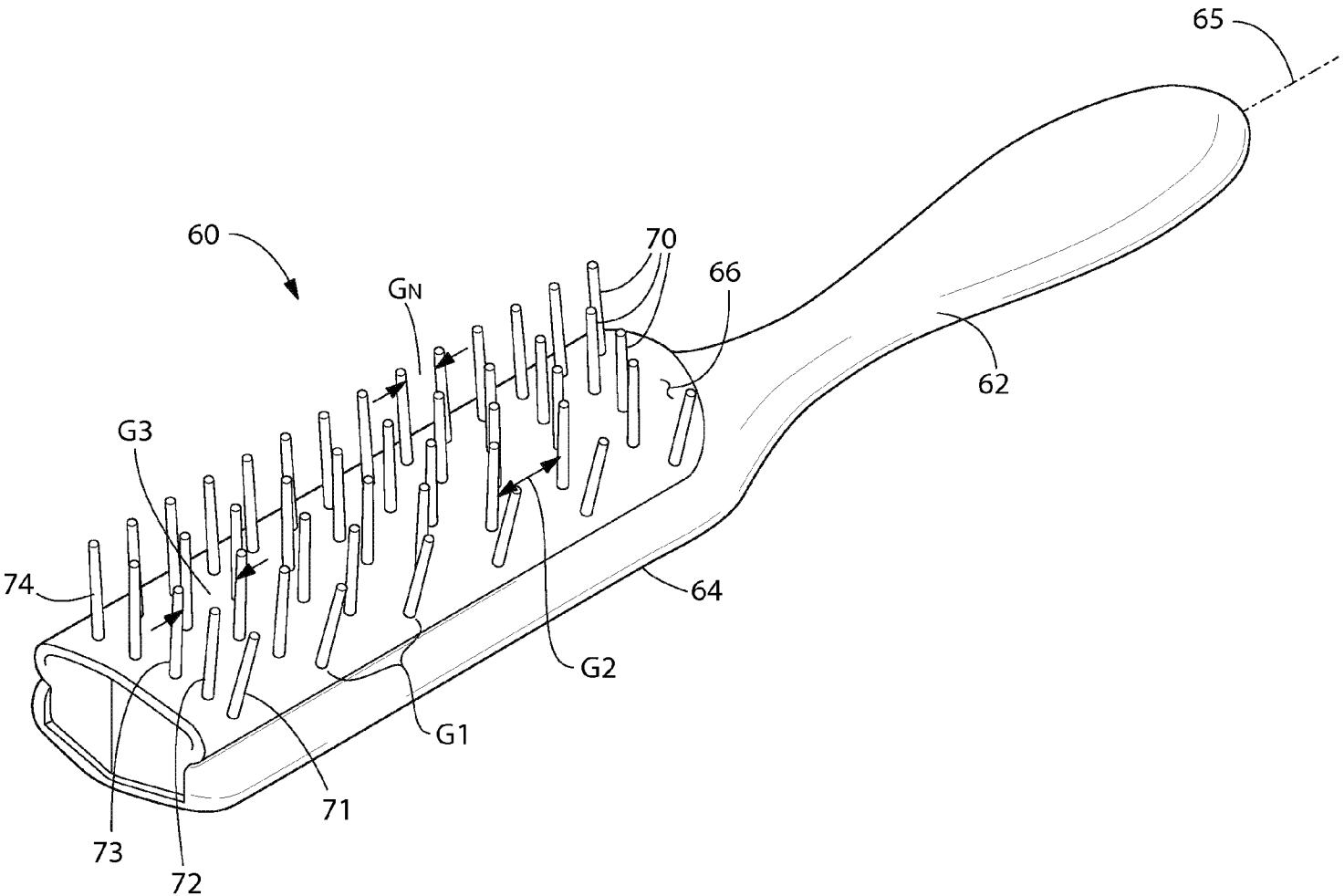
FIG. 6 is a perspective view of a third exemplary embodiment of a hairbrush in accordance with the present invention.

Referring to FIG. 6, a third embodiment of a brush 60 is shown in accordance with the present invention. The brush 60 has a handle 62 and a head 64. The head 64 of the brush 60 has a face surface 66 from which a plurality of prongs 70 extend. The face surface 66 of the head 64 can be flat. However, in the illustrated embodiment the face surface 66 is curved, having a generally convex shape.

The plurality of prongs 70 extend from the face surface 66 of the head 64. The prongs 70 are arranged in a series of parallel rows and columns. For the purpose of reference, the rows are considered the lines of prongs 60 parallel to the longitudinal axis 65 of the handle 62. The columns are the lines of prongs 70 perpendicular to the longitudinal axis 65 of the handle 62.

As can be seen, when the brush 60 is laid flat, each of the rows 71, 72, 73, 74 of prongs are parallel. However, the number of prongs 70 in each row varies. Furthermore, the gap space between the prongs 70 of each row varies from row to row. The first row 71 of prongs 70 has only a few prongs. The gap space G1 between adjacent prongs 70 is large. The second row 72 has a number of prongs 70 greater than the first row 71. Accordingly the gap space G2 of the second row 72 is smaller than the gap space G1 on the first row 71. The third row 73 has a number of prongs 70 greater than that of the second row 72. Accordingly the gap space G3 of the prongs 70 of the third row 73 are smaller than the gap space G2 on the second row 72. The pattern is repeated for each subsequent row of prongs 70. It will therefore be understood that the last row 74 of prongs 70 has the greatest number of prongs and the smallest gap space Gn between prongs.

Figure 7:
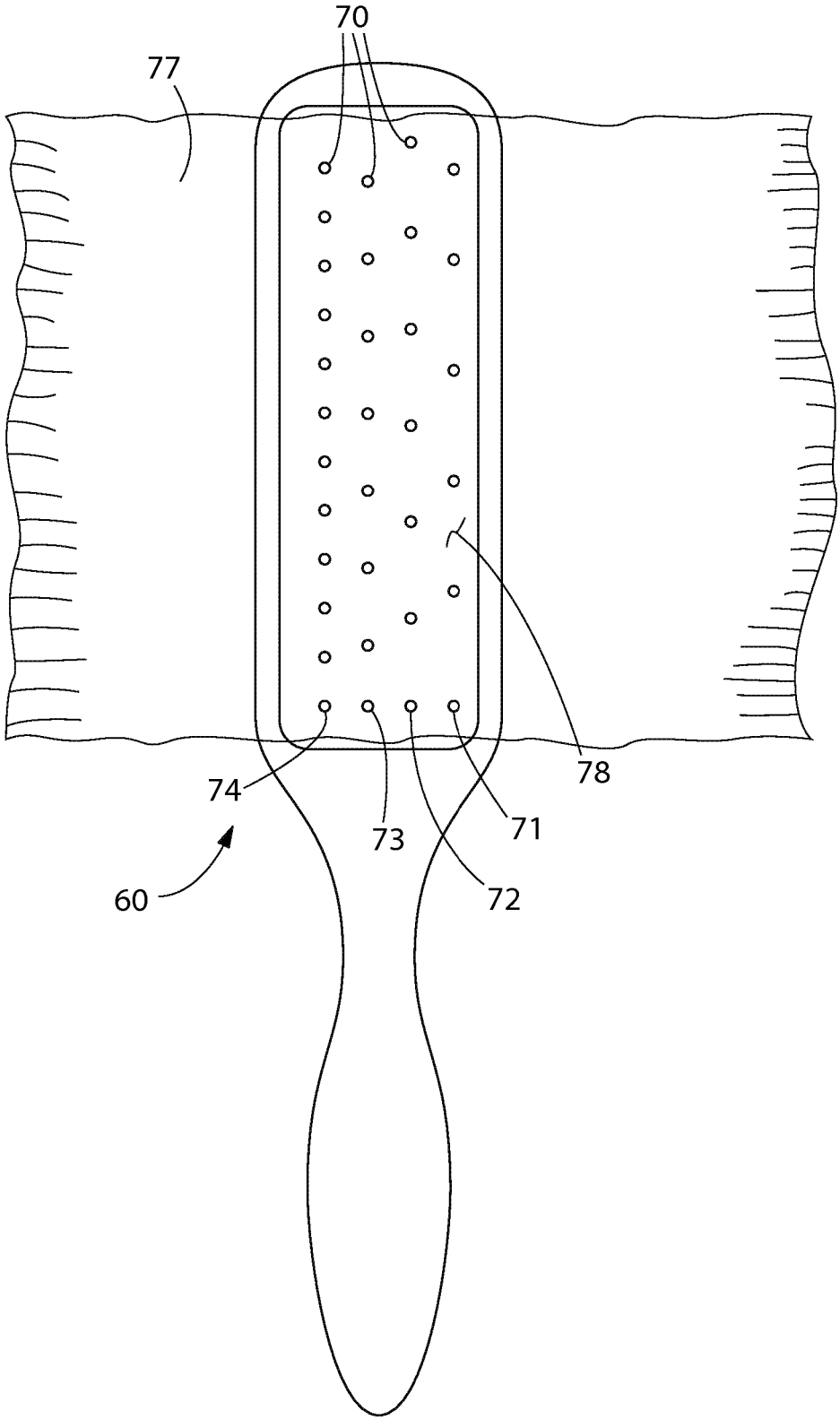
FIG. 7 is a top view of the head of the hairbrush shown in FIG. 6 engaging a lock of hair.

When brushing a person's hair, the prongs of a brush are advanced into a lock of hair 77 and then pulled through the hair toward the free ends of the hair. Referring to FIG. 7, it can be seen that when a present invention brush 60 is advanced through a lock of hair 77, each row of prongs 70 divide the hair into a different number of pathways 78. The size of the pathway 78 is equal to the gap space between prongs 70. The first row 71 of prongs divides the lock of hair 77 along only a few pathways 78. The number of pathways 78 is equal to the number of prongs 70 plus one. Since the gap space G1 between the first row 71 of prongs 70 is large, very little resistance from tangling is encountered.

As the hair is advanced to the second row 72 of prongs 70, it is already subdivided into smaller segments. Each of the smaller segments is then further subdivided by the prongs 70 on the second row 72. These are again subdivided by the prongs 70 of the third row 73. The pattern is repeated until the last row 74. In addition to the lock of hair 77 being repeatedly subdivided, any tangle present in the hair is also subdivided. Since the subdivisions occur gradually, the tangles are undone gradually and the tangles do not create significance resistance to the movement of the brush 60.

Experimentation was preformed comparing the pull forces of the present invention embodiment of FIGS. 6 and 7 with a traditional brush having the same number of prongs in each row. Results show that the present invention has a mid-length pull force through the lock of hair that is 40% lower than that of a prior art brush. Likewise, the end-peak force of the present invention was 70% lower than that of a prior art brush.

It will be understood that the mid-length pull force and the end-peak force vary as a function of hair type and brush design. The numbers cited are calculated from real experimental data achieved using a typical brush design and a single hair type.

Figure 8:
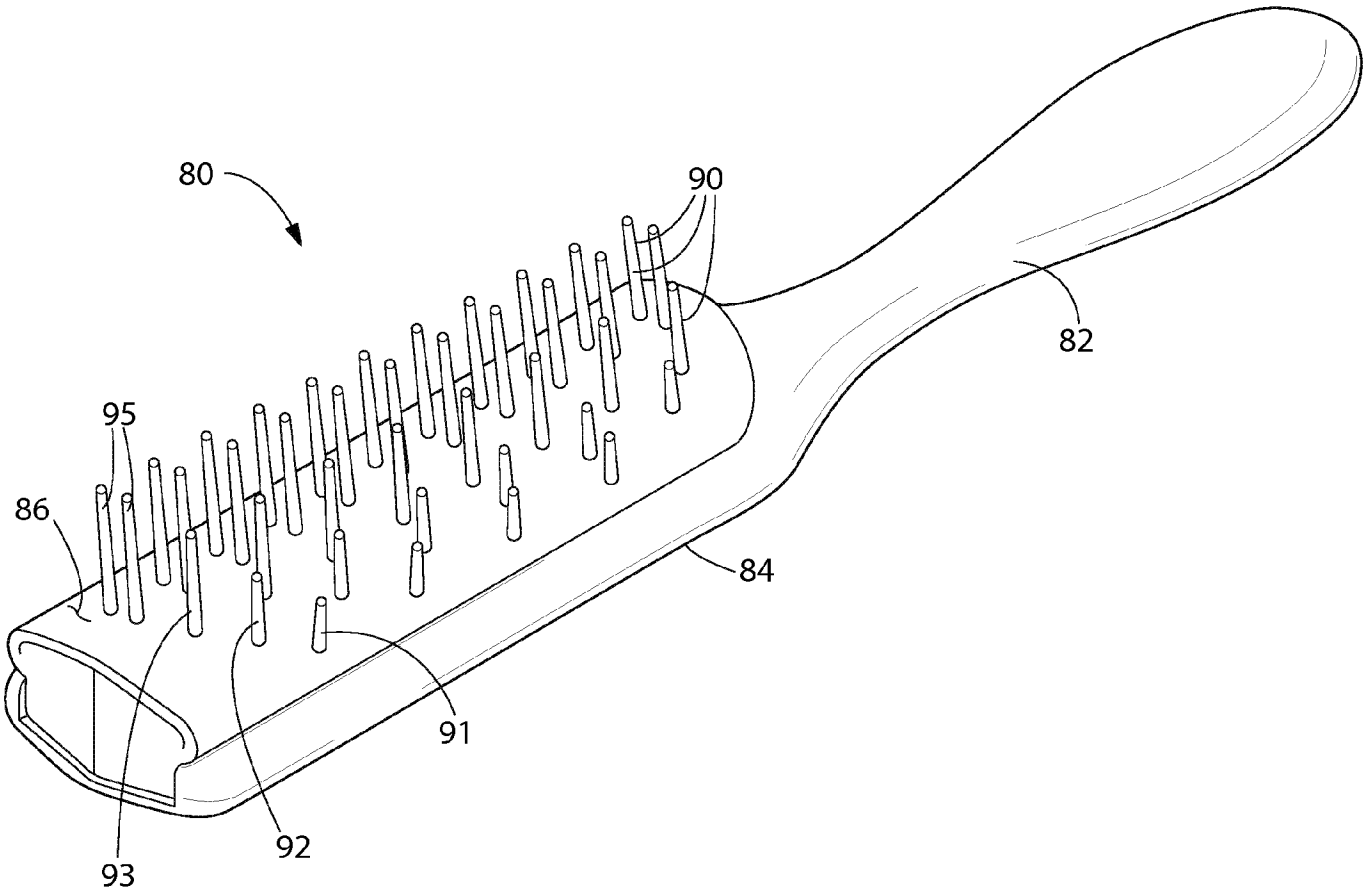
FIG. 8 is a perspective view of a fourth exemplary embodiment of a hairbrush in accordance with the present invention.

It will be understood that the three previously described embodiments of a brush all make it easier to brush tangled hair. The technology of the three embodiments can be combined in part or in whole. Such a combination is described in FIG. 8. In FIG. 8 a combined embodiment of a brush 80 is shown in accordance with the present invention. The brush has a handle 82 and a head 84. The head 84 of the brush 80 has a face surface 86 from which a plurality of prongs 90 extend. The face surface 86 of the head 84 can be flat. However, in the illustrated embodiment the face surface 86 is curved, having a generally convex shape.

The plurality of prongs 90 extend from the face surface 86 of the head 84. The prongs 90 are arranged in a series of parallel rows that include a first row 91, a second row 92 and a third row 93. The prongs in the first row 91 terminate at a shorter height than the prongs 90 in subsequent rows, such as in the embodiment of FIG. 1. The prongs 90 in the first row 91 are fewer in number than prongs 90 in subsequent rows, such as in the embodiment of FIG. 4. Lastly the prongs 90 in the first row 91 are spaced wider than the prongs 90 in the subsequent rows, such as in the embodiment of FIG. 6. Accordingly, the embodiment of FIG. 8 has the combined benefits of all previously described embodiments.

Furthermore, the embodiment of FIG. 8 shows the previously mentioned concept of redundant rows 95, wherein two rows may be identical before transforming into an alternately constructed row.

In the embodiment of FIG. 8, it is also preferred that the prongs 90 of the different rows have a different rigidity. It is preferred that the prongs 90 in the first row 91 have a rigidity less than that of the prongs 90 in the second row 92. Likewise, the prongs 90 in the second row 92 are preferably less rigid than the prongs 90 of the third row 93. This pattern of increasing rigidity continues until the last row.

The rigidity of the prongs 90 can be altered by altering either the diameter of the prongs 90 or the diameter and taper of the prongs 90.

In all the embodiments thus shown, the first row of prongs is located at one edge of the face surface of the brush and the last row is at the opposite side. This produces a brush that can only be used effectively in one direction. It should be understood that the configurations of the prongs can be mirrored around a center point in a brush. In this manner, there are two identical first rows at opposite edges of the brush. The last row of the brush is in the center of the brush. This creates a two-way brush that can be used in either direction.

It will be understood that the embodiments of the present invention that are illustrated and described are merely exemplary and that a person skilled in the art can make many variations to those embodiments. For instance, the shape of the brush head can be varied in many ways. Furthermore, the number of prongs, the number of prong rows, and the number of prong columns can also be varied from the embodiments illustrated. Additionally, individual prongs can be replaced by tufts of bristles, wherein the tufts of bristles act collectively as a prong. All such embodiments are intended to be included within the scope of the present invention as defined by the claims.

What is claimed is:

1. A method of configuring the prongs on a hairbrush to reduce the force needed to advance the hairbrush through a lock of hair, said method comprising the steps of:

providing a brush head having a face surface and a plurality of prongs extending from said face surface, said head further having first and second opposite sides extending along the length thereof, said prongs being arranged in a plurality of parallel rows, wherein said rows include a first row of prongs, a last row of prongs, and subsequent rows of prongs disposed between said first row of prongs and said last row of prongs, wherein said first row of prongs, said last row of prongs and said subsequent rows of prongs pass through said lock of hair as said brush head is pulled along said lock of hair to brush said lock of hair, said first row of prongs being disposed at and adjacent the first side of the head and said last row of prongs being disposed at and adjacent the second side of the head;

providing a first number of prongs in said first row of prongs so that said first row of prongs engages a first volume of hair from said lock of hair when said brush head is pulled along said lock of hair to brush said lock of hair;

providing a last number of prongs in said last row of prongs, wherein said last number of prongs is greater than said first number of prongs and all of said first number of prongs in said first row of prongs align in straight columns with some of said last number of prongs in said last row of prongs, wherein said straight columns are perpendicular to said plurality of parallel rows, and wherein said last row of prongs engages a last volume of hair that is greater than said first volume of hair as said brush head is pulled along said lock of hair to brush said lock of hair; and providing prongs in said subsequent rows of prongs that are greater in number than said first number of prongs and less in number than said last number of prongs, wherein each of said subsequent rows of prongs has a different number of prongs, and wherein said different number of prongs increases as said subsequent rows of prongs approach said last row of prongs from said first row of prongs, wherein all of said subsequent number of prongs align in said straight columns with some of said last number of prongs in said last row of prongs.

2. The method according to claim 1, further including the step of providing at least one redundant row of prongs between said first row of prongs and said subsequent rows of prongs.

3. The method according to claim 1, further including the step of providing at least one redundant row of prongs between said subsequent rows of prongs and said last row of prongs.

4. The method according to claim 1, wherein said step of providing a first number of prongs in said first row of prongs includes terminating said first row of prongs at a first height, and said step of providing a last number of prongs in said last row of prongs includes terminating said last row of prongs at a last height that is greater than said first height.

5. The method according to claim 4, wherein said step of providing prongs in said subsequent rows of prongs includes terminating said subsequent rows of prongs at different heights that are greater than said first height and less than said last height.

6. The method according to claim 1, wherein said step of providing a first number of prongs in said first row of prongs includes providing prongs that are evenly spaced.

7. The method according to claim 1, wherein said last row of prongs and said first row of prongs have equal prong spacing.

8. The method according to claim 7, wherein said first row of prongs align in parallel columns with at least some of said last row of prongs.

9. The method according to claim 7, wherein said last row of prongs and said subsequent rows of prongs have equal prong spacing.

10. The method according to claim 1, wherein said first row of prongs, said subsequent rows of prongs and said last row of prongs all have a differing prong rigidity.

11. A hairbrush comprising:

a brush head having a face surface, said head further having first and second opposite sides extending along the length thereof;

a handle extending from said brush head; and a plurality of prongs extending from said face surface, said prongs being arranged in a plurality of parallel rows that include a first row of prongs, a second row of prongs and a third rows of prongs, said first row of prongs being disposed at and adjacent the first side of the head and said third row of prongs being disposed at and adjacent the second side of the head with the second row of prongs being disposed between the first and third row of prongs wherein said first row of prongs are fewer in number and are spaced wider than said second row of prongs and said second row of prongs are fewer in number and are spaced wider than said third row of prongs.

* * * * *